US010975625B2

(12) United States Patent
Gray

(10) Patent No.: US 10,975,625 B2
(45) Date of Patent: Apr. 13, 2021

(54) SIMPLE ROTARY STEERABLE DRILLING SYSTEM

(71) Applicant: Ian Gray, Acacia Ridge (AU)

(72) Inventor: Ian Gray, Acacia Ridge (AU)

( * ) Notice: Subject to any disclaimer, the term of this patent is extended or adjusted under 35 U.S.C. 154(b) by 0 days.

(21) Appl. No.: 16/766,846

(22) PCT Filed: Nov. 23, 2018

(86) PCT No.: PCT/AU2018/051254

§ 371 (c)(1),
(2) Date: May 26, 2020

(87) PCT Pub. No.: WO2019/100116

PCT Pub. Date: May 31, 2019

(65) Prior Publication Data

US 2020/0318437 A1 Oct. 8, 2020

(30) Foreign Application Priority Data

Nov. 27, 2017 (AU) ..... 2017904782

(51) Int. Cl.
*E21B 7/06* (2006.01)
*E21B 17/10* (2006.01)
(Continued)

(52) U.S. Cl.
CPC ..... *E21B 7/067* (2013.01); *E21B 7/068* (2013.01); *E21B 17/1014* (2013.01); *E21B 3/00* (2013.01); *E21B 7/062* (2013.01); *E21B 47/024* (2013.01)

(58) Field of Classification Search
CPC . E21B 7/067; E21B 7/068; E21B 3/00; E21B 7/062; E21B 17/1014; E21B 47/024; E21B 7/06
See application file for complete search history.

(56) References Cited

U.S. PATENT DOCUMENTS 5,421,421 A * 6/1995 Appleton ..... E21B 7/06 175/76
6,467,834 B1 * 10/2002 Barz ..... B62D 25/04 296/187.02

(Continued)

FOREIGN PATENT DOCUMENTS

WO WO 2007/115397 10/2007

*Primary Examiner* — Nicole Coy
(74) *Attorney, Agent, or Firm* — Roger N. Chauza, PC

(57) ABSTRACT

A steering collar for deflecting a drill string in a borehole to cause the borehole to be drilled in a different direction. The steering collar surrounds a hollow drive shaft which is driven by the drill string. During normal drilling operations, the steering collar does not rotate with the drive shaft. The steering collar has three sets of pistons operated by the pressure of the drilling fluid, one set of which is pressure relieved. Drill fluid that is pumped down the drill string flows into the hollow drive shaft and through ports to activate the pistons which thereby force corresponding pads outwardly into contact with the sidewall of the borehole. Since the one set of pistons is pressure relieved, it does not force its pad against the borehole sidewall with as much pressure as the other two sets of pistons force their pads against the sidewall of the borehole. Accordingly, the steering collar is deflected laterally in the borehole so that the drill bit is also steered laterally to cause drilling in a different direction. In order to reorient the steering collar in the borehole, the steering collar can be locked to the drive shaft so that when the drill string is rotated, the steering collar is also rotated so that it is moved to a new angular position in the borehole.

20 Claims, 8 Drawing Sheets

(51) Int. Cl.
*E21B 3/00* (2006.01)
*E21B 47/024* (2006.01)

(56) References Cited

U.S. PATENT DOCUMENTS

| | | | | |
|---|---|---|---|---|
| 6,550,548 | B2 * | 4/2003 | Taylor | E21B 7/062 175/317 |
| 7,413,034 | B2 | 8/2008 | Kirkhope et al. | |
| 7,681,665 | B2 * | 3/2010 | Eppink | E21B 17/1014 175/76 |
| 9,797,204 | B2 * | 10/2017 | Kirkhope | E21B 17/021 |
| 10,287,821 | B2 * | 5/2019 | Marson | E21B 7/062 |
| 10,364,608 | B2 * | 7/2019 | Lines | E21B 7/067 |
| 2001/0052428 | A1 * | 12/2001 | Larronde | E21B 7/062 175/61 |
| 2002/0112892 | A1 | 8/2002 | Taylor | |
| 2005/0098353 | A1 * | 5/2005 | Maxwell | E21B 17/1014 175/57 |
| 2012/0061148 | A1 * | 3/2012 | Clausen | E21B 7/06 175/267 |
| 2012/0168230 | A1 | 7/2012 | Gocke et al. | |
| 2015/0107902 | A1 | 4/2015 | Downton | |
| 2016/0348438 | A1 * | 12/2016 | Kirkhope | E21B 47/024 |
| 2018/0128060 | A1 * | 5/2018 | Haugvaldstad | E21B 17/1014 |

* cited by examiner

SIMPLE ROTARY STEERABLE DRILLING SYSTEM

TECHNICAL FIELD OF THE INVENTION

The invention relates to the field of directionally controlled drilling of boreholes.

BACKGROUND OF THE INVENTION

Any discussion of the prior art throughout the specification should in no way be considered as an admission that such prior art is widely known or forms part of common general knowledge in the field.

The drilling of a borehole in a controlled direction has evolved to more efficiently reach deposits of hydrocarbon materials. Rather than drilling a borehole downwardly to access underlying deposits of gas and oil, with the advent of directional drilling a borehole can be drilled downwardly at a convenient location on the surface and then laterally to a remote location where the hydrocarbon deposit is located. Initially, drillers found that by putting weight on the drill bit they could cause the borehole to deviate. The placement of centralisers on the drill string could be used to control the rate at which such deviation would occur. Although this technique worked, the problem was controlling the direction in which the drill string would deviate the path of the borehole.

One of the early systems that controlled the direction of borehole deviation involved the use of a jetting drill bit. In this case, the drill string rotation is halted and an eccentric jet from the bit is used to erode the formation in the direction in which it is desired to drill the borehole. A jetting cycle is followed by rotation of the drill string to enable drilling to proceed in the new direction. This process can be repeated if multiple adjustments to the trajectories are desired.

Another common system for adjusting the direction of boreholes, particularly those used for coring, is the use of a wedge. This requires the removal of the drill string and drill bit from the borehole. This is followed by the attachment of the wedge on the bottom of the drill string and then lowering the drill string into the borehole where the wedge is then disengaged from the drill string. The drill string is then again removed, and the bit is again fitted to the drill string and run to the location of the downhole wedge. Drilling can then re-commence, and be deviated by the wedge. This is a laborious process and is really suitable only for cases where a branch off the main borehole must be drilled, rather than for continuous directional control.

The next major development in directionally controlled drilling came with the development of down hole mud motors. These motors are mounted behind the drill bit at the base of the drill string and form part of a bottom hole assembly. The passage of fluid through the drill string causes the mud motor to rotate the drill bit, thus enabling cutting without the need to rotate the entire drill string. To directionally drill with this type of bottom hole assembly, of which the down hole mud motor is a part, such assembly contains one or more bends so that the drill string will build an angle in a particular direction if it is slid within the hole. Rotating such an assembly in a near horizontal borehole generally leads to the hole drooping under the effects of gravity on the drill string and bit so that directional control is either reduced or lost.

Drilling while sliding the non-rotating drill string further into the borehole has significant limitations. The first of these is that cuttings will build up within any borehole of adequately flat trajectory causing increased friction. With intermediate borehole angles, the cuttings bed may suddenly dislodge causing a hole blockage which can trap the drill string. The second problem is that with greater borehole lengths which are angled, the frictional resistance to drilling becomes greater. This leads to stick-slip behaviour which makes drilling with a down hole mud motor uncontrollable. Rotating the drill string either prevents or reduces the stick-slip behaviour.

Further problems can occur with sliding drilling near horizontal holes in some formations, where the drill string does not rotate the bit. In this instance, the drill string does not rotate within the borehole but rather slides through the borehole. Instead, the bit at the end of the drill string is rotated by a down hole mud motor. In these cases, a cuttings bed builds up and the space for the cuttings to pass over the top of the drill string and the cuttings bed becomes limited. If a larger fragment of the formation falls into the borehole then it may cause a partial blockage to the passage of other cuttings, which rapidly becomes complete. This borehole jam further complicates the drilling process as the jammed cuttings are compressed by drilling mud flow into a sealing collar which can then trap the drill string within the borehole.

To overcome these problems, the drill string must be rotated. To enable rotary drilling with directional control the development of rotary steering systems has been undertaken. The means of directional control is by the use of a collar that exists on the drill string as part of the bottom hole assembly. This collar does not rotate significantly and contains pads to push the drill string from side to side in the borehole. There are two basic mechanisms for correcting the trajectory of the drill bit. The first is by placing the adjustable collar close behind the drill bit. With this arrangement, the trajectory control is called push the bit (sideways). The second mechanism is to place a centralising collar close behind the drill bit, and place the adjustable collar some distance behind this. With this arrangement, the directional control is achieved by using the pads on the adjustable collar to bend the drill string about the front stabiliser which acts as a fulcrum. This type of system achieves directional control primarily by pointing the bit in the desired direction.

These rotary steering systems use sophisticated controls to adjust the pads on the collar to achieve directional control. The systems are typically electronic over hydraulic control and operate dynamically during the drilling process. The control is typically based on down hole sensors such as magnetometers and accelerometers which provide inputs to the electronics located in the bottom hole assembly. Steering information is conveyed to the rotary steering tool via telemetry from surface equipment.

These rotary steering tools are expensive to build and operate. There is thus a need for a simpler, low cost system for applications such as directional drilling for the installation of utilities or for mining, rather than for deep oilfield purposes. This is one of the objects achieved by the steerable collar according to the invention.

Another benefit of a more simplified rotary steerable system is that it enables drilling to be achieved with lower drilling fluid flow rates than would be required to drive a mud motor. This is possible because the rotation of the drill string provides the cutting means. Also, the fluid flow rate required to move cuttings is reduced because of the constant agitation of the cutting chips caused by the rotation of the drill string.

SUMMARY OF THE INVENTION

According to one aspect of the invention, there is provided a rotary drilling system of the type having a drill string that rotates and drives a drill bit to provide directional control in the formation of a borehole, comprising:

a bottom hole assembly connected to the drill string, said bottom hole assembly comprising:

a steering collar;

a drive shaft that is coupled to the drill string and to said drill bit, said drive shaft passing through a said steering collar;

said steering collar being lockable to said drive shaft in response to a first pressure of said drilling fluid coupled down the drill string, whereby the steering collar rotates with the drill string to position said steering collar at a desired angular location in the borehole;

at least one pressure relieved piston responsive to a second pressure of the drilling fluid for operating a respective thrust pad against a sidewall of the borehole to push said steering collar in an opposite direction;

at least two spaced apart non-pressure relieved pistons, each responsive to the second pressure of the drilling fluid for operating respective thrust pads against the sidewall of the borehole to push the steering collar in directions different from that of said pressure relieved piston; and a drilling fluid pump for pumping the drilling fluid at desired flow rates to operate lock said drive shaft to said steering collar, and said second drilling fluid pressure to operate said pistons.

According to a further aspect of the invention, there is provided a rotary drilling system of the type having a drill string that rotates and drives a drill bit to provide directional control in the formation of a borehole, comprising:

a bottom hole assembly that includes;

a drive shaft driven by the drill string, said drive shaft having an axial bore therethrough to couple drilling fluid therethrough from the drill string to the drill bit;

a steering collar having an axial bore therethrough through which said drive shaft extends, said steering collar being lockable to said drive shaft in response to a first pressure of a drilling fluid coupled down said drill string, whereby said steering collar rotates with said drill string to position said steering collar at a desired angular location in said borehole; said steering collar having:

at least one pressure relieved piston responsive to a second pressure of the drilling fluid for moving axially outwardly from said steering collar;

a first pad that moves in response to the movement of said pressure relieved piston, said first pad for engaging a sidewall of the borehole;

at least one non-pressure relieved piston responsive to the second pressure of the drilling fluid for moving axially outwardly from said steering collar in a direction different from said pressure relieved piston; and a second pad that moves in response to the movement of said non-pressure relieved piston, said second pad for engaging a sidewall of the borehole;

whereby when the drilling fluid is pumped down the drill string, said pressure relieved piston is forced against the sidewall of the borehole with less force than said non-pressure relieved piston, thereby forcing said steering collar, said drive shaft and said drill bit in a lateral direction in said borehole to thereby deviate the direction of drilling the borehole.

According to yet a further embodiment of the invention, there is provided a rotary drilling system of the type having a drill string that rotates and drives a drill bit to provide directional control in the formation of a borehole, comprising:

a bottom hole assembly that includes;

a drive shaft driven by the drill string, said drive shaft having an axial bore therethrough to couple drilling fluid therethrough from the drill string to the drill bit;

a steering collar having an axial bore therethrough through which said drive shaft extends, an annular space between said steering collar and said drive shaft defining an annulus for carrying pressurized drilling fluid, said steering collar further including:

at least two pistons responsive to the pressure of the drilling fluid coupled through the annulus between said steering collar and said drive shaft, said at least two pistons for moving axially outwardly from said steering collar to push said steering collar laterally in the borehole, said two pistons located less than 180 degrees apart around a circumference of said steering collar;

a respective pad moved by each of said two pistons for engaging respective portions of a sidewall of the borehole; and a peg movable by a piston in response to a pressure of the drilling fluid, said peg for locking said steering collar to said drive shaft so that movement of the drill string is effective to rotate said steering collar to a desired angular orientation within said borehole;

whereby when the pistons of the steering collar are deployed, the steering collar is displaced laterally in the borehole to thereby deviate the path of the borehole, and for so long as said pistons are deployed the steering collar does not rotate but slides within the borehole during drilling to continue deviating the path of the borehole.

It is an object of the present invention to overcome or ameliorate at least one of the disadvantages of the prior art, or to provide a useful alternative.

A feature of the invention is that it may be used in either a push the bit mode or a point the bit mode for directional control. An embodiment of the invention comprises a bottom hole assembly with a steering collar through which passes a drive shaft which rotates with the drill string. The steering collar is equipped with laterally extendable steering pads that are used to achieve directional control. The principal difference from the other systems that are available is the manner in which directional control is achieved. This involves orientating the steering collar manually. During normal drilling operations, the steering collar does not rotate, but the drill string does rotate to thereby rotate the drive shaft and the drill bit. The manual orientation of the steering collar is achieved by locking it to the drive shaft and rotating the drill string and drive shaft and thus the steering collar to the desired orientation. Once the steering collar is oriented at the desired angular orientation in the borehole, the steering collar is unlocked from the drive shaft for the purpose of continued drilling in a controlled direction.

To enable manual orientation, the steering collar includes a system to unload the sets of steering pads and lock the steering collar to drive shaft and thus to the drill string so the components are rotated together for orientation purposes. The locking of the drive shaft to the steering collar occurs below a certain flow rate of drilling fluid. When drilling fluid is pumped through the system at a sufficient flow rate, a differential pressure is developed between the inside and the outside of the tool that disengages the locking mechanism, thus freeing the drill string to rotate without rotating the steering collar. This differential pressure is generated by the flow of drilling fluid through a flow restriction located downstream within either the drive shaft or the drill bit.

Raising the flow rate of the drilling fluid further increases the differential pressure across the flow restriction and therefore between the inside and outside of the tool. The differential pressure causes pistons to operate on three respective alignment thrust pads hinged to the steering collar and be forced outwardly against the sidewalls of the borehole. Initially, the various sets of pistons are forced outwardly with an even force. However, as the drilling fluid flow rate is increased one set of the pistons vents, or is pressure relieved, to a predetermined pressure. The fluid flow and therefore pressure that is available to these pressure relieved pistons is restricted by ports so that the pressure difference across these pistons is essentially held at a constant value. The pressure acting on the other two sets of pistons is controlled by the flow rate of the drilling fluid past the orifice. At greater flow rates, two sets of pistons and associated thrust pads push with increased force against the well bore while the third pressure limited piston set pushes with a fixed and lower force. The drill string can thus be deflected laterally within the well bore. The force by which the drill string is deflected is dependent on the flow rate of drilling fluid through the system. The deflected steering collar causes the drill string at that location to also deflect laterally so that the drilling bit is moved laterally to drill in the deflected direction.

In operation, the system is designed to be used in a rotary drilling situation, which reduces stick-slip of the drill string that may occur in directional sliding drilling using a down hole mud motor. To achieve directional control, the pumping of drilling fluid is stopped, thus reducing the differential pressure in the system. This permits the locking mechanism to engage between the drive shaft and the steering collar. The drill string may then be rotated and with it the drive shaft and steering collar until the collar is at the desired angular orientation. To achieve the desired angular orientation of the steering collar in the borehole, the drill string need be rotated a single revolution to fully engage the shaft locking mechanism plus the desired directional angle. Pumping of the drilling fluid then recommences. The locking mechanism between the drive shaft and the steering collar is then disengaged by the action of differential pressure caused by drilling fluid flow. At a certain low pumping rate, the steering collar will apply equal forces between all three thrust pads to drill straight ahead. If, however the pumping rate (and therefore drilling fluid pressure) is raised further it will cause two of the sets of alignment pads to be forced outwards at a greater force than the third pad, thus causing the drill string to be laterally deflected within the borehole. This deflection may be used close to the drill bit to push it sideways. The deflection may alternatively be used to bend the drive shaft and the drill string in a point the bit manner. Rotation of the drill string and application of thrust to the drill bit leads to cutting the borehole in a directionally controlled manner.

As the system relies on the steering collar not rotating during the drilling cycle, the orientation of the steering collar must be regularly checked by the use of a borehole survey tool. To prevent the rotation of the collar within the hole while drilling, the alignment pads are preferably fitted with sharpened edges or a sharp fin of a hard material attached to the thrust pads so as to maintain their angular alignment within the borehole. The survey tool employed can be of conventional construction and readily available to determine the angular orientation of the steering collar within the borehole. By reducing the drilling fluid flow to enable the engagement of the locking system between the shaft and the steering collar, and by rotating the drill string a single turn, the drill string and drive shaft attached thereto will be engaged at a known relative position with the survey tool. Information from the survey tool may then be returned to the borehole collar using various means of telemetry including a cable connection within the drill string, a mud pulse system or electromagnetic communication information. The operator is able to then rotate the drill string to orientate the steering collar accordingly.

According to one type of survey tool located downhole in the drill string, it contains three magnetometers and three accelerometers. The output of these sensor devices is used to determine the orientation of the tool with respect to the gravitational and magnetic fields of the earth. The output is typically in terms of tool azimuth, inclination and tool face angle. The latter is typically referenced to magnetic North or up directions.

In more detail, when there is a need to change the trajectory of the borehole, the process to do this would be as follows. First, drill thrust would be stopped, then rotation of the drill string would be stopped. The pumping of drilling fluid would also be stopped to allow the steering collar to be locked to the drive shaft. A borehole survey may then be taken to obtain a tangent of the drill string position. This with prior survey information may be used to determine the borehole path by processes including integration, fitting of great circles or cubic splines to the individual survey points. Then the drill string would be rotated slowly one turn clockwise. This rotation process would ensure that the drill string and steering collar are locked together with a known relative position with respect to each other. Further rotation of the drill string can be used to orient the steering collar to the desired angle within the borehole so that directional change may be achieved. The drilling fluid is then pumped through the drill string to first unlock the steering collar from the drive shaft and drill string and secondly to extend the thrust pads outwardly evenly. The flow rate is further increased to apply a greater force in two of the thrust pads than the force applied in the third thrust pad, thus generating the desired degree of drill string deflection. The rotation of the drill string is then commenced followed by drill thrust in order to continue drilling of the borehole with the desired angular change in the borehole path. When it is thought that sufficient deviation of the borehole path has been achieved, the drill string rotation can be stopped and the borehole again surveyed. A decision on how to drill the next section of the borehole may then be made.

The main advantages of the invention are its simplicity, the ability to drill at an angular build rate that is adjustable down hole by drilling fluid flow rate, the fact that the drill string rotates thus relieving problems associated with cuttings bed build up or stick-slip sliding and the ability to drill with lower fluid flow rates than would be the case with the utilization of a down hole mud motor.

BRIEF DESCRIPTION OF THE DRAWINGS

Further features and advantages will become apparent from the following and more particular description of the preferred embodiment of the invention, as illustrated in the accompanying drawings in which like reference characters generally refer to the same parts, components or elements throughout the views, and in which.

DETAILED DESCRIPTION OF THE INVENTION

Figure 1:
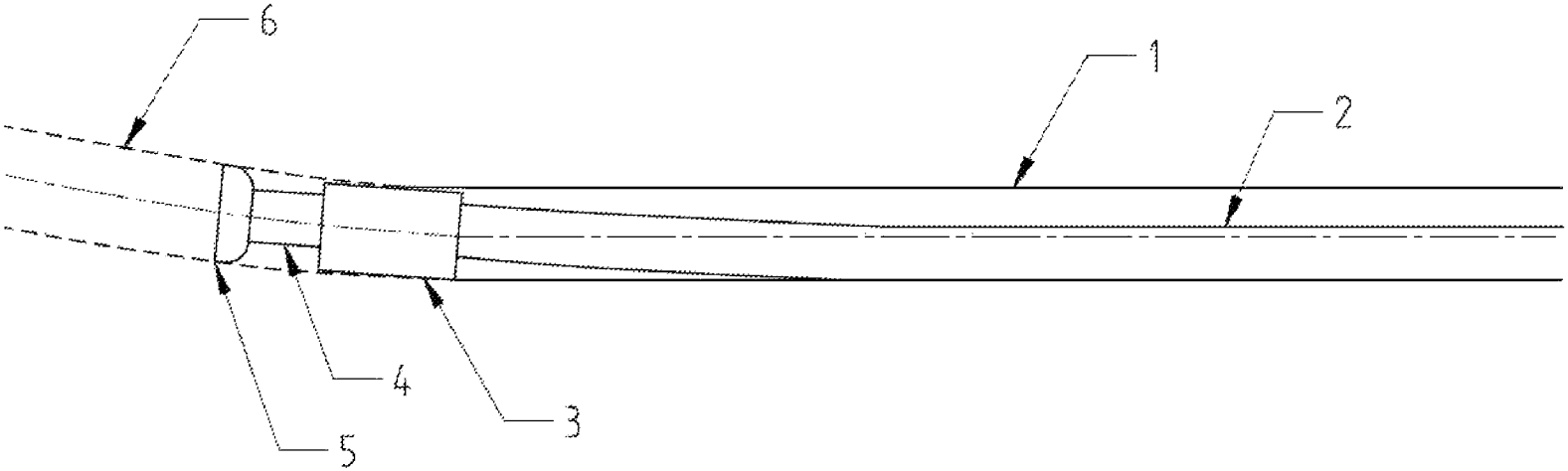
FIG. 1 illustrates the steering collar tool being used to push the bit laterally to achieve directional control.

FIG. 1 illustrates a horizontal borehole (1) in which a drill string (2) lies on the bottom thereof until deflected by the steering collar (3). The steering collar (3) enables the transmission of the rotating motion of the drill string from its right hand side (as shown) to an extended part of the drill string (4) on its left hand side, and then to the drill bit (5) itself. Because the steering collar (3) laterally deflects the drill string (4) and the bit (5), the latter cuts a deviated path and will continue to do so in the desired path (6). In this form, the steering collar (3) is being used to push the bit (5) sideways to effect a directional change of the borehole (1). It should be appreciated that the steering collar (3) may be used in this mode to push in any lateral direction in the borehole (1) to change the alignment of the borehole (1).

Figure 2:
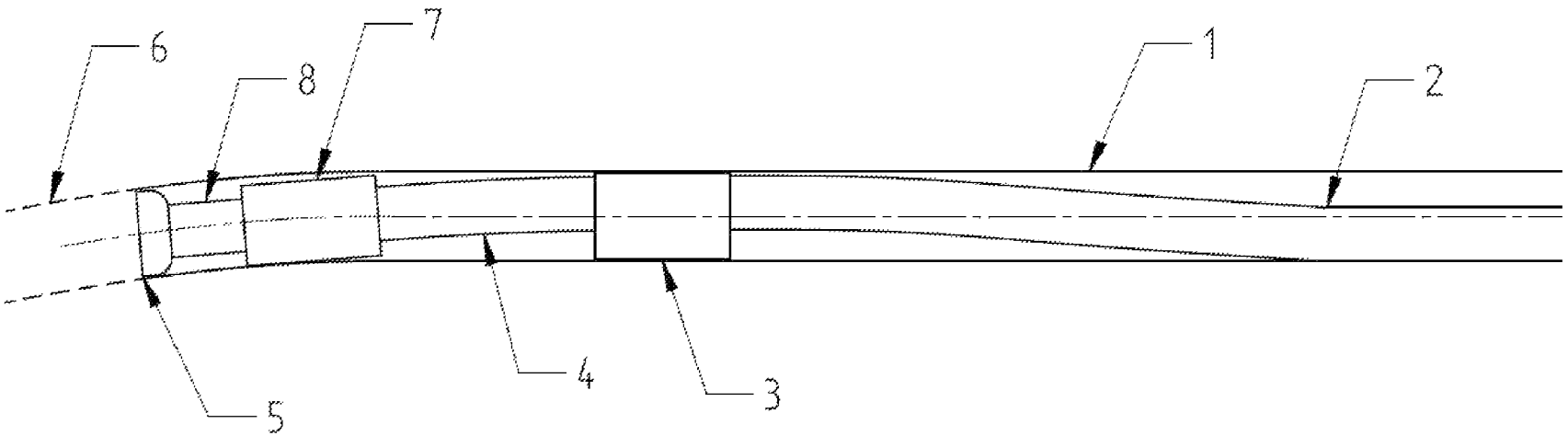
FIG. 2 illustrates the steering collar tool being used to point the bit to achieve directional control.

FIG. 2 illustrates the borehole (1) in which the drill string (2) lies on the bottom of the borehole (1) in the right side of the drawing. It is deflected by a steering collar (3) and the drill string (4) continues to the left side up to the location of a drill centraliser (7) and thence as (8) to the drill bit (5). The sideways thrust of the steering collar (3) within the borehole (1) forces the drill string sections (2) and (4) to effectively bend. The centraliser (7) acts as a fulcrum pointing the extended part of the drill string (8) and the drill bit (5) to drill a projected path (6). This mode is a point the bit system. As can be appreciated, both modes of operation utilize the same steering collar (3).

Figure 3:
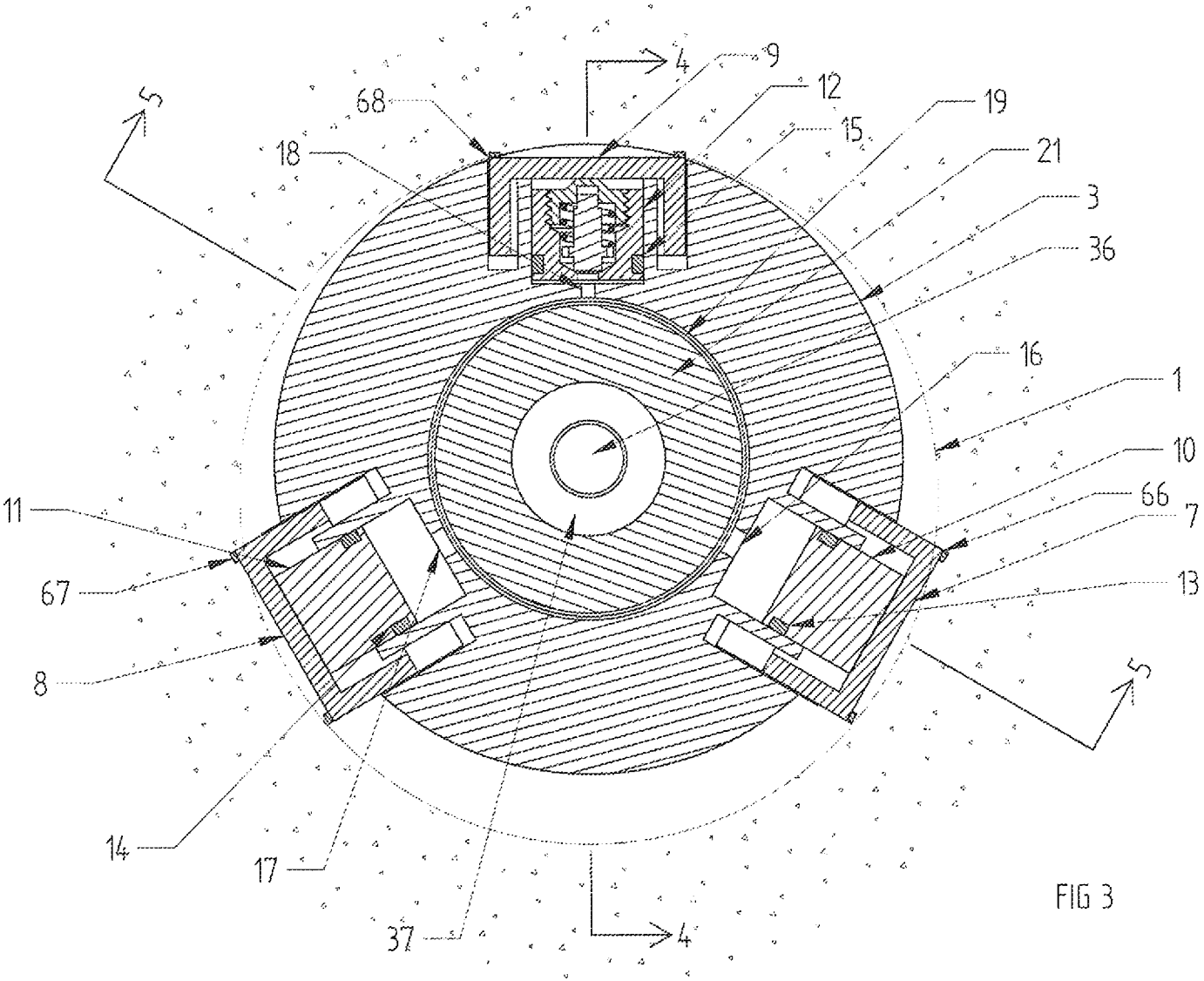
FIG. 3 is a cross-sectional view taken along line 3-3 of FIG. 4, and illustrates a transverse section of the steering collar tool with various longitudinal section portions.

FIG. 3 illustrates a section of the steering collar (3) in schematic form. The body of the steering collar (3) is shown pushed laterally upwardly off centre within the borehole (1). Through the steering collar body (3) passes a drive shaft (21) which transmits rotating motion, torque and thrust from the drill string (2) to the drill bit (5). Between the steering collar body (3) and the drive shaft (21) is an annulus (19) which carries drilling fluid at a pressure which is higher than that existing in the borehole annulus between the steering collar body (3) and the borehole (1). The drilling fluid in the drive shaft annulus (19) is derived from drilling fluid that is carried through a central bore (36) formed within the drive shaft (21). Three thrust pads (7), (8) and (9), each located about one hundred twenty degrees apart on the steering collar (3), are pushed toward or into contact with the sidewall of the borehole (1) by three respective groups or sets of pistons (10), (11) and (12). In practice, each group of pistons (10), (11) and (12) is comprised of one or several pistons. The set of pressure-relieved pistons (12) is constructed differently from the non-pressure relieved sets of pistons (10) and (11). These pistons are driven outward by the difference in the drilling fluid pressure between the drive shaft annulus (19) and the borehole annulus located outside of the steering collar body (3). Piston sets (10) and (11) are simple pistons which carry respective elastomeric seals (13) and (14). Drilling fluid is supplied to the base of the piston cylinders (in which the pistons (10) and (11) are located) via respective ports (16) and (17). The base of piston (12) is supplied with fluid via a metering port (18). The piston (12) carries an elastomeric seal (15) and also carries a pressure relief system that is shown in more detail in FIG. 6. At lower drilling fluid flow rates and pressures, all pistons (10), (11) and (12) bear outwardly against the thrust pads (7), (8) and (9) which bear outwardly against the sidewall of the borehole (1) with equal force. When the pressure in the drive shaft annulus (19) rises above a certain level, the piston (12) vents into the annulus within the borehole (1), thus limiting the differential pressure across the piston (12). The replenishment of the drilling fluid to the base of the piston (12) is limited by the metering port (18). Each of the three sets of pistons (10), (11) and (12) is equipped with respective shoes or thrust pads (7), (8) and (9) that push against the sidewall of the borehole (1) to move the collar (3) to an off-centre position. The thrust pads (7), (8) and (9) carry respective fins (66), (67) and (68) that bear against the sidewall of the borehole (1) to minimise rotation of the steering collar body (3) while drilling ahead. The effect of differing pressures applied to the pads (7) and (8) as compared to pad (9) is that the steering collar (3) tends to be forced to the side of the borehole (1) adjacent the piston equipped with the pressure relief system (12). This is illustrated in FIG. 3 where the top of the borehole (1) is adjacent the pressure relief piston (12), and the steering collar (3) is forced to the top of the borehole (1). The higher the drilling fluid pressure in the central bore (36) of the drive shaft (21), compared to that in the annulus between the steering collar body (3) and the borehole (1), the greater this net side force is. This pressure differential is controlled by the rate at which the drilling fluid is pumped through an orifice (37) located within the central bore (36) of the drive shaft (21).

Figure 4:
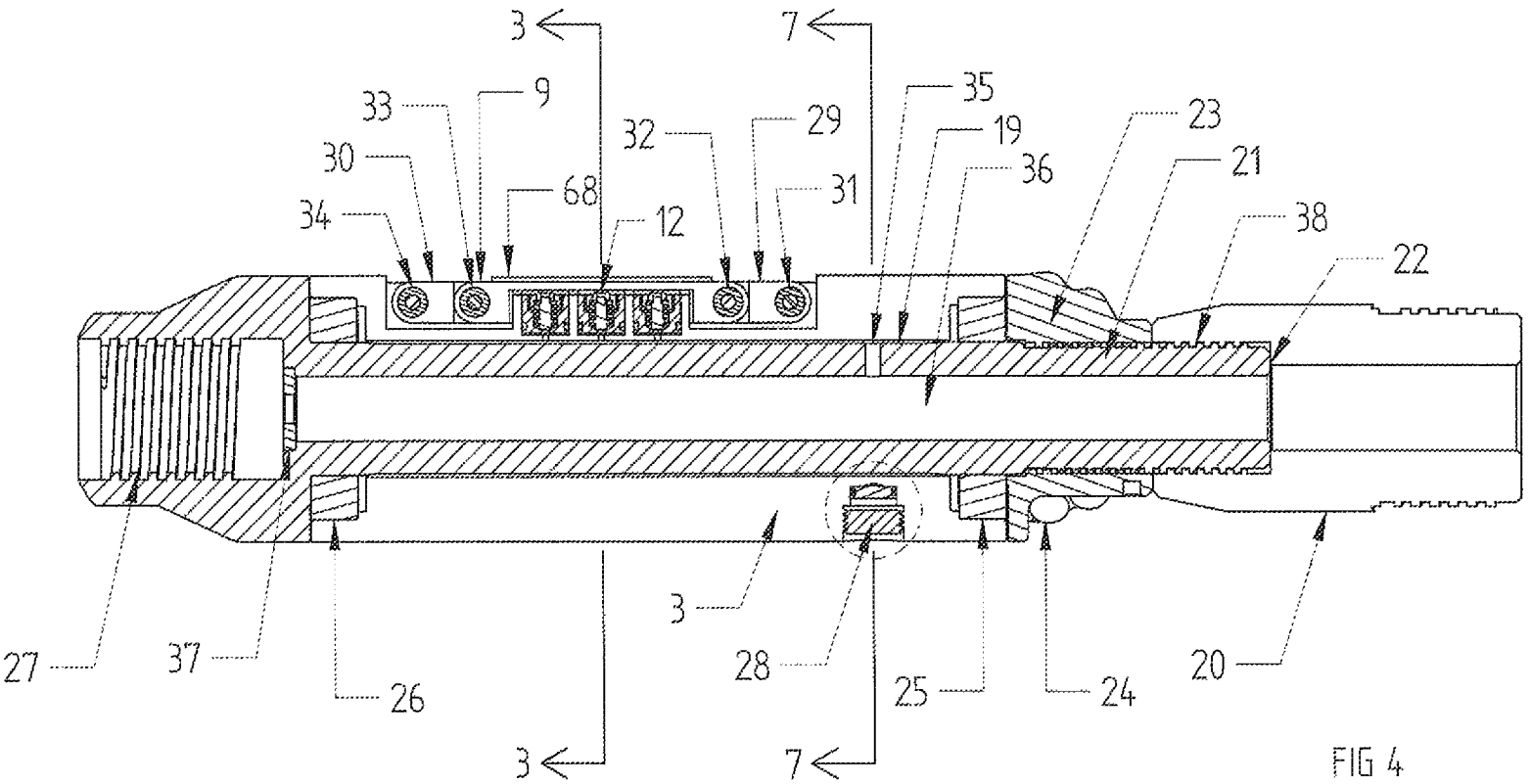
FIG. 4 is a cross-sectional view taken along line 4-4 of FIG. 3, and illustrates a longitudinal section of the steering collar tool through the set of pressure relieved pistons.

FIG. 4 illustrates a cross-sectional view of the steering collar (3) taken along line 4-4 of FIG. 3. Here, all three pressure relieved pistons of the set (12) are shown. In the right side of the drawing is a drive sub (20) that screws into the upstream drill string pipe section (not shown) This transmits thrust and torque to the drive shaft (21) via a threaded connection (38). The threaded connection (38) bears against the internal end of the drive sub (20) via an adjustment shim (22). Also on this threaded connection (38) is a locking assembly (23). This contains cutters (24) that enable the assembly to cut its way backwards out of the borehole (1) should the borehole (1) collapse or otherwise become blocked. As noted above, the drive shaft (21) passes through the body of the steering collar (3). The left hand side of the drive shaft (21) extends beyond the body (3) and contains a downstream threaded connection (27) which can transmit thrust and torque to the drill string section (4) (in FIG. 1 or 2) which is screwed into it. At the base of the threaded connection (27) is a plate containing the orifice (37) which causes a fluid pressure drop as drilling fluid is pumped from right to left. The drive shaft (21) is supported within the steering collar body (3) by bearings (25) and (26) so that the drive shaft (21) can rotate and transmit torque downstream without rotating the steering collar (3). These bearings (25) and (26) are preferably of an angular contact ball race construction. To make up the steering collar (3), the drive shaft (21) is inserted through the bearings (26) and (25), and the locking assembly (23) is then screwed onto the drive shaft threads (38). The drive sub (20) is then tightened against the end of the drive shaft (21) via the adjustment shim (22). The locking assembly (23) is then tightened against the drive sub (20) to lock the drive sub onto the threads of connection (38).

FIG. 4 also illustrates a section through the thrust shoe or pad (9) associated with the set of pistons (12) that act upon it. A fin (68) attached to the thrust pad (9) extends outwardly to contact the borehole wall to inhibit rotation of the steering collar while the thrust pad (9) is in the extended position. The three pressure relieved pistons (12) of the set underlie the elongated thrust pad (9). The thrust pad (9) is attached on each end thereof to respective links (29) and (30) via pin and bush assemblies (32) and (33). These links (29) and (30) are in turn recessed in the outer surface of the steering collar body (3) by pin and bush assemblies (31) and (34). The bushes within the pin and bush assemblies (31 to 34) are made of an elastomer that permits the pad (9) and link (29 and 30) assembly to extend outwardly when it is pushed away from the body (3) by the set of pistons (12). The elastomeric bushes also pull the pad (9) and link (29 and 30) assembly back into the steering body (3) when the set of pistons (12) are no longer energised. Also shown is the position of the locking peg assembly (28). This assembly (28) locks the drive shaft (21) to the steering collar body (3) for orientation purposes when a fluid pressure difference between the outside of the collar body (3) and that in the drive shaft annulus (19) is low. Drilling fluid is conveyed from the inside of the drive shaft (21) via port (35) to the drive shaft annulus (19) around the drive shaft (21) and thence via the ports 18 (FIG. 3) to the set of pistons (12). The other two sets of pistons (10) and (11) receive pressurized drill fluid in a similar manner via respective ports (16) and (17) (FIG. 3).

Figure 5:
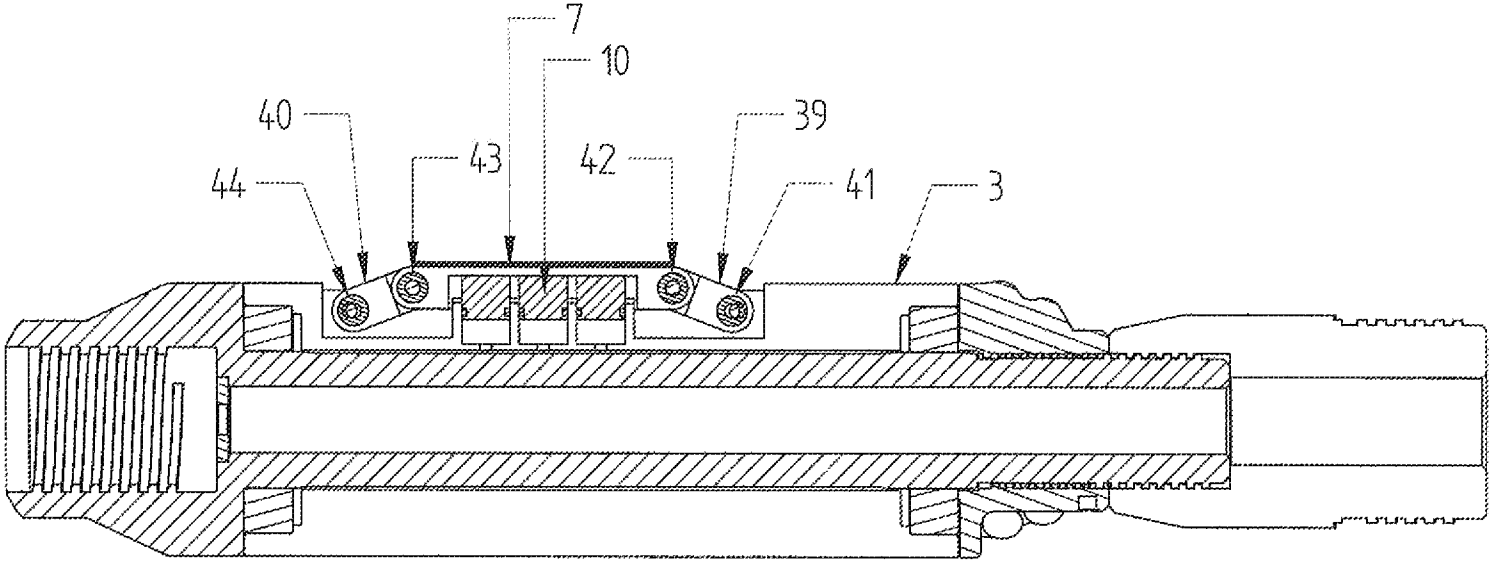
FIG. 5 is a cross-sectional view taken along line 5-5 of FIG. 3, and illustrates a longitudinal section of the steering collar tool through one set of the two sets of non-pressure relieved pistons.

FIG. 5 illustrates a cross-sectional view of the steering collar (3) taken along line 5-5 of FIG. 3. Here, all three non-pressure relieved pistons of the set (10) are shown. The other set of non-pressure relieved pistons of the set (11) is similarly constructed. In particular, illustrated is the thrust pad (7) and associated links (39 and 40) and pin and elastomeric bush assemblies (41 to 44) in section. In this view, the set of pistons (10) are shown extended from the steering body (3) by fluid pressure delivered to the inner end of the set of pistons (10). In this extended condition the thrust pad (7) pushes against the sidewall of the borehole (1) thus deflecting the body of the steering collar (3) in the opposite direction within the borehole (1).

Figure 6:
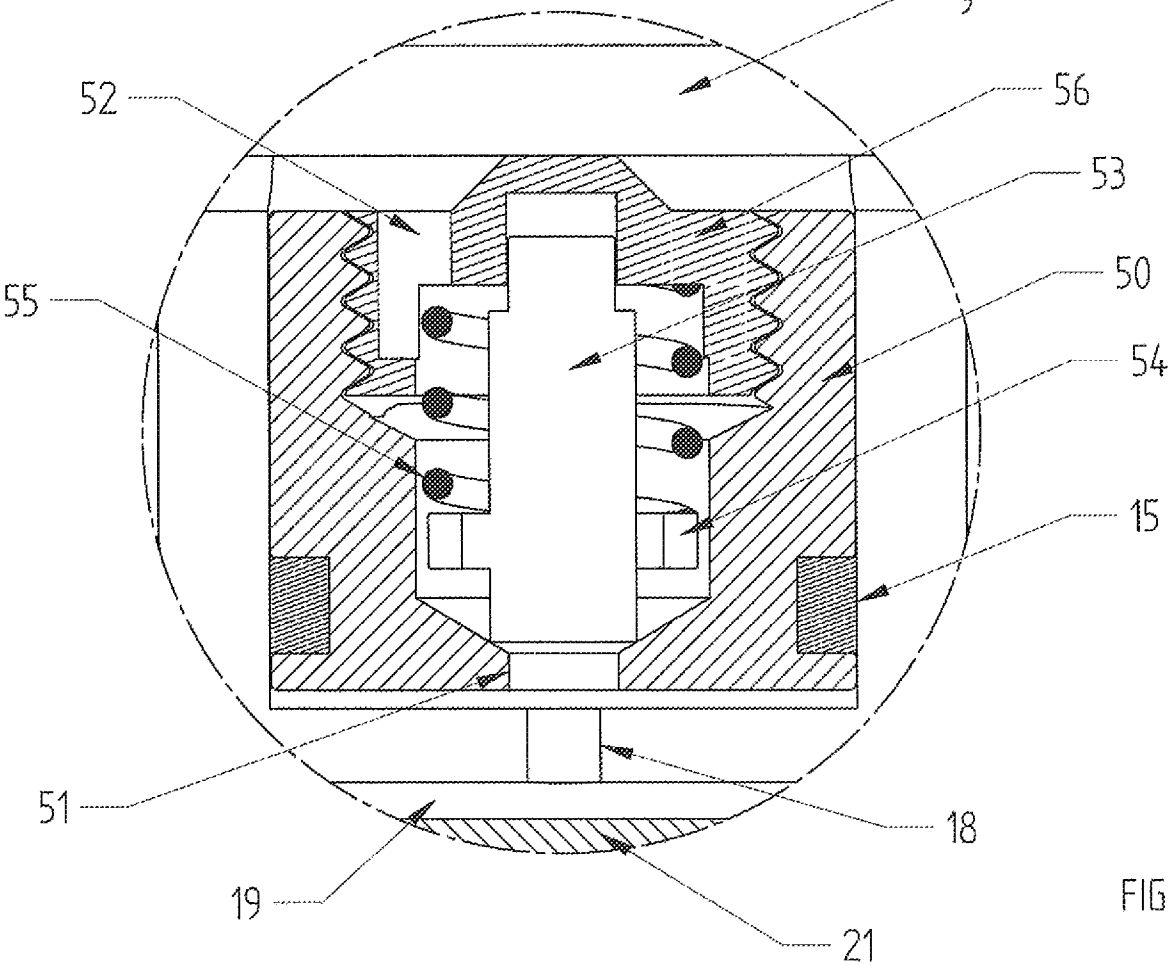
FIG. 6 illustrates a detailed section of one of the three pressure relieved pistons.

FIG. 6 illustrates an enlarged sectional view of one pressure relieved piston of the set (12) of FIGS. 3 and 4. The piston (12) is located in a cylindrical bore which is fed at its base by drilling fluid via port (18). The pressurised drilling fluid pushes the set of pistons outwardly against the thrust pad (9) via the threaded and ported component (56). When the fluid pressure exceeds a certain design value, the pin (53) lifts within the piston body (50), thus opening the piston (50) to the through flow of the drilling fluid. This occurs via port (51) in the base of the piston around the centralisers (54), which do not occlude fluid flow. The drilling fluid continues flowing past the spring (55) and out via port (52) located within component (56) into the space between the top of the piston body (50) and the pad (9). The force on the piston (12) is thus limited by the dimension of port (18) and the pressure relief characteristics of the piston assembly. The spring (55) functions to return the pin (53) to the downward position when the drilling fluid pressure is lowered.

Figure 7:
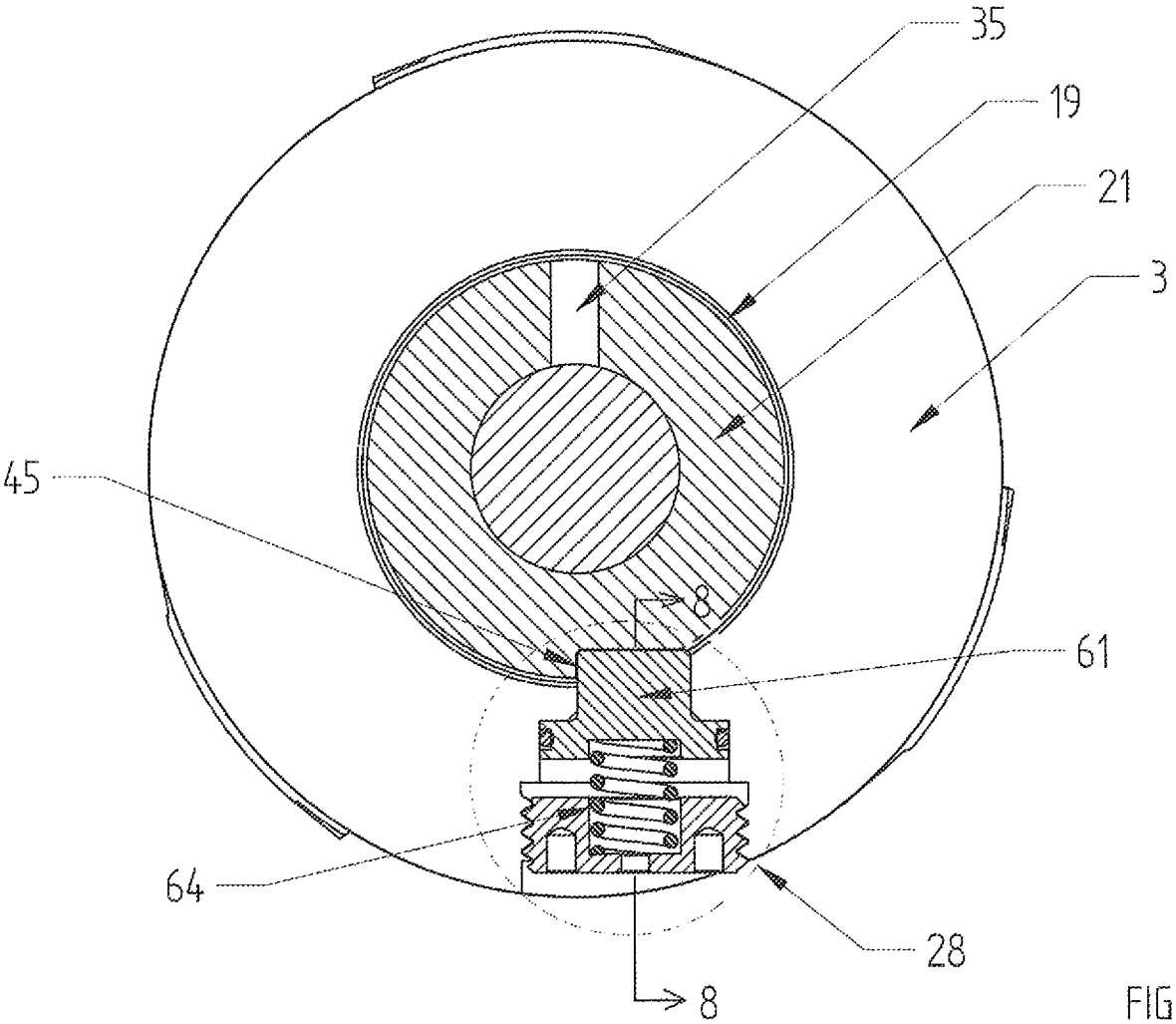
FIG. 7 is a cross-sectional view taken along line 7-7 of FIG. 4, and illustrates a transverse section of the steering collar tool with the locking mechanism.

FIG. 7 is a cross-sectional view of the steering collar (3) taken along line 7-7 of FIG. 4. In this drawing, the peg (61) of the locking peg assembly (28) is shown engaged in a notch (45) formed within the drive shaft (21). With the peg (61) in this position, the drive shaft (21) may be rotated clockwise to turn the steering collar body (3) clockwise within the borehole (1). When the peg (61) is engaged in the shaft notch (45), the rotation of the drive shaft (21) with the drill string (2) is effective to relocate the steering collar (3) in the borehole (1) so that the pistons (9), (10) and (11) and corresponding thrust pads (7), (8) and (9) are positioned to deviate the drilling in a desired direction. When fluid is flowing through the drive shaft (21) it will be at a higher pressure than the fluid outside the steering collar (3) and within the annulus of the borehole (1). When a sufficient flow rate is reached, the differential fluid pressure will raise the locking peg (61) against the spring (64) and out of the notch (45), allowing the drive shaft (21) to rotate freely of the steering collar body (3).

Figure 8:
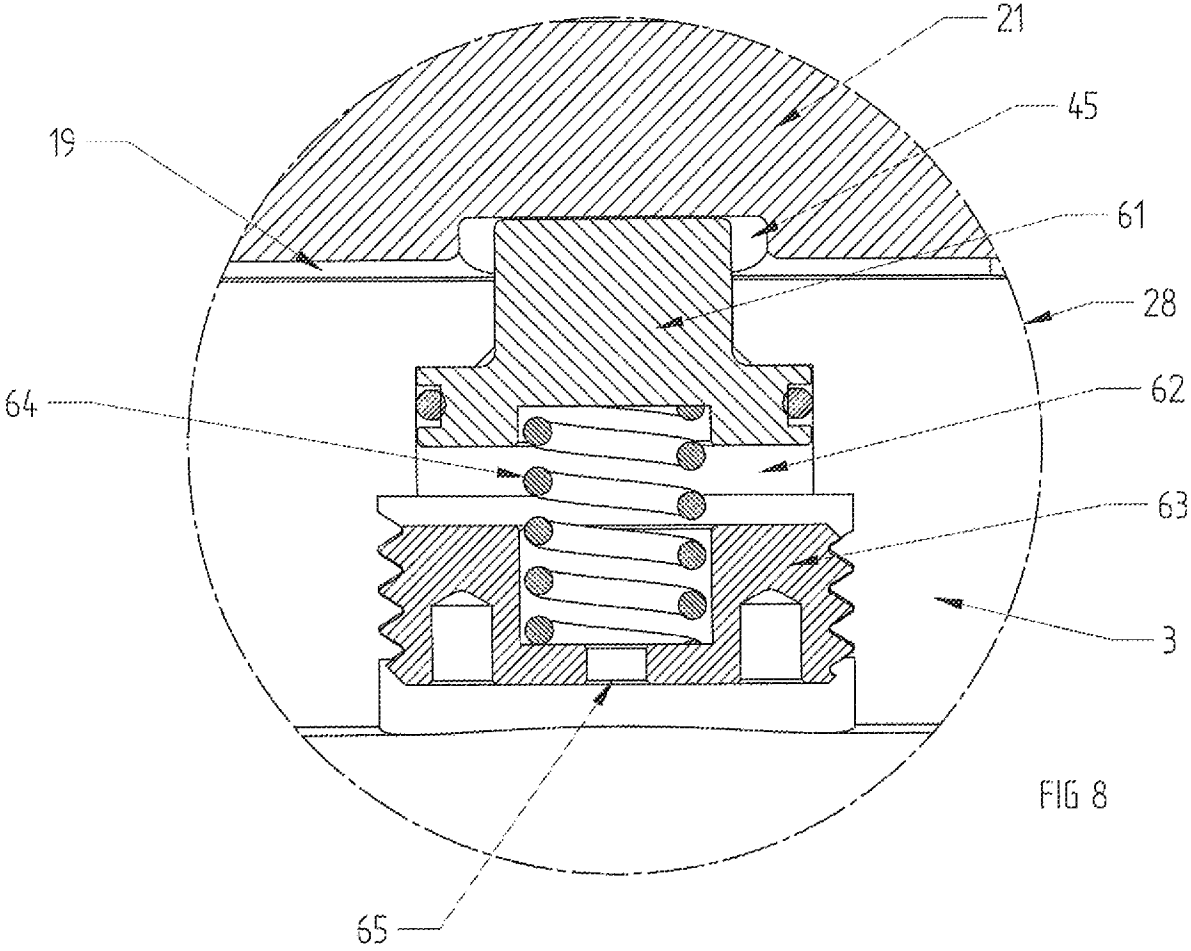
FIG. 8 is a cross-sectional view taken along line 8-8 of FIG. 7, and illustrates the locking mechanism in detail.

FIG. 8 illustrates the locking peg assembly (28) in more detail. The peg (61), which is contained within the cylindrical bore (62), is shown engaged in the notch (45) formed in the drive shaft (21). It is held in this position by the spring (64) that pushes against the bottom cap (63) which is screwed into the steering collar body (3). The cap (63) contains a port (65) which is in communication with the drilling fluid outside of the steering collar body (3). When the differential pressure between the drive shaft annulus (19) and the outside of the body (3) exceeds the compressive resistance of the spring (64), the peg (61) is pushed out the notch (45) in the drive shaft (21), thus enabling the drive shaft (21) to rotate within the steering collar body (3). In this mode normal drilling can take place.

From the foregoing, it should be understood that while the preferred embodiment of the invention has been described in connection with three pistons constituting a set, other numbers of pistons can be employed as a set. Also, the embodiment of the invention is described with three sets of pistons located about one hundred and twenty degrees around the rotary collar, it is understood that the angular positions of the sets of pistons could be other than one hundred and twenty degrees. Further, while the preferred embodiment contemplates the use of a pressure relieved piston and non-pressure relieved pistons to move the steering collar laterally within the borehole, those skilled in the art may prefer to omit the pressure relieved piston and utilize only the non-pressure relieved pistons to move the steering collar sideways in the borehole to modify the direction of drilling.

While the preferred embodiment of the invention has been disclosed with reference to a specific steerable collar, it is to be understood that many changes in detail may be made as a matter of engineering choices without departing from the spirit and scope of the invention, as defined by the appended claims.

Unless the context clearly requires otherwise, throughout the description and the claims, the words "comprise", "comprising", and the like are to be construed in an inclusive sense as opposed to an exclusive or exhaustive sense; that is to say, in the sense of "including, but not limited to".

The invention claimed is:

1. A rotary drilling system of the type having a drill string that rotates and drives a drill bit to provide directional control in the formation of a borehole, comprising:

a bottom hole assembly connected to the drill string, said bottom hole assembly comprising:

a steering collar:

a drive shaft that is coupled to the drill string and to said drill bit, said drive shaft passes through said steering collar;

said steering collar is lockable to said drive shaft in response to a first pressure of drilling fluid coupled down the drill string, whereby said steering collar rotates with the drill string to position said steering collar at a desired angular location in the borehole;

at least one pressure relieved piston responsive to a second pressure of the drilling fluid for operating a respective thrust pad against a sidewall of the borehole to push said steering collar in an opposite direction;

at least two spaced apart non-pressure relieved pistons, each responsive to the second pressure of the drilling fluid for operating respective thrust pads against the sidewall of the borehole to push the steering collar in directions different from that of said pressure relieved piston; and a drilling fluid pump for pumping the drilling fluid at desired flow rates to operate a locking mechanism to lock said drive shaft to said steering collar, and a second drilling fluid pressure to operate said pistons.

2. The rotary drilling system of claim 1, wherein said pressure relieved piston, and said two non-pressure relieved pistons are located about 120 degrees apart around said steering collar.

3. The rotary drilling system of claim 1, where each said thrust pad is attached to said steering collar with hinged links that allow said thrust pads to extend radially outwardly from an outer surface of said steering collar.

4. The rotary drilling system of claim 3, wherein said each said pad includes a fin that is pushed into a sidewall of the borehole to prevent said steering collar from rotating when the borehole is drilled by said drill bit.

5. The rotary drilling system of claim 1, wherein said pressure relieved piston includes an orifice that controls the pressure of the drilling fluid applied thereto.

6. The rotary drilling system of claim 1, wherein said steering collar includes a hollow body with said drive shaft extending thereto, said drive shaft having an axial bore extending therethrough, and pressurized drilling fluid passes through the axial bore and through a lateral bore in said drive shaft to an annulus located between an outer cylindrical surface of said drive shaft and an inner cylindrical surface of a body of said steering collar.

7. The rotary drilling system of claim 6, wherein each said pressure relieved piston and each said non-pressure relieved piston is operated by the pressurized drilling fluid in said annulus.

8. The rotary drilling system of claim 1, wherein said steering collar includes cutting edges on a back side thereof to allow the steering collar to cut material when withdrawn by said drill string from the borehole.

9. The rotary steering system of claim 1, further including a flow restriction which under drill fluid flowing conditions permits the development of a differential pressure between the inside of the steering collar and the outside of the steering collar so as to permit the operation of said locking mechanism between the drive shaft and the steering collar and also to actuate the pistons of the steering collar.

10. A rotary drilling system of the type having a drill string that rotates and drives a drill bit to provide directional control in the formation of a borehole, comprising:

a bottom hole assembly that includes;

a drive shaft driven by the drill string, said drive shaft having an axial bore therethrough to couple drilling fluid therethrough from the drill string to the drill bit;

a steering collar having an axial bore therethrough through which said drive shaft extends, said steering collar having:

at least one pressure relieved piston responsive to the pressure of the drilling fluid for moving axially outwardly from said steering collar;

a first pad that moves in response to the movement of said pressure relieved piston, said first pad for engaging a sidewall of the borehole;

at least one non-pressure relieved piston responsive to the pressure of the drilling fluid for moving axially outwardly from said steering collar in a direction different from said pressure relieved piston;

a respective second pad that moves in response to the movement of said at least one non-pressure relieved piston, said second pad for engaging a sidewall of the borehole; and whereby when the drilling fluid is pumped down the drill string, said pressure relieved piston is forced against the sidewall of the borehole with less force than said at least one non-pressure relieved piston, thereby forcing said steering collar, said drive shaft and said drill bit in a lateral direction in said borehole to thereby deviate the direction of drilling the borehole.

11. The rotary drilling system of claim 10, wherein said steering collar is rotatable around said drive shaft, and further including a peg for locking said steering collar to said drive shaft so that when said drill string is rotated, said steering collar rotates therewith.

12. The rotary drilling system of claim 11, further including a locking piston for moving said peg to lock said steering collar to said drive shaft, said locking piston responsive to a pressure of the drilling fluid to move said peg to lock said steering collar to said drive shaft.

13. The rotary drilling system of claim 10, further including a respective guide vane attached to each said first and second pad, said guide vanes engaging within the sidewall of the borehole to prevent rotation of said steering collar while said steering collar is pushed forwardly during drilling of the borehole.

14. The rotary drilling system of claim 10, further including an annulus between said steering collar and said drive shaft, said annulus for carrying pressurized drilling fluid that is coupled to said pressure relieved piston and to said non-pressure relieved piston for operation thereof.

15. The rotary drilling system of claim 14, wherein there is a drill string annulus between the drill string and the borehole, and wherein pressurized drilling fluid is coupled to said pressure relieved piston for operation thereof and then released into the drill string annulus to thereby reduce the force by which said pressure relieved piston is extended radially outwardly.

16. The rotary drilling system of claim 15, wherein the path of the borehole deviates in a direction related to the sidewall of the borehole acted upon by said pressure relieved piston.

17. A rotary drilling system of the type having a drill string that rotates and drives a drill bit to provide directional control in the formation of a borehole, comprising:

a bottom hole assembly that includes;

a drive shaft driven by the drill string, said drive shaft having an axial bore therethrough to couple drilling fluid therethrough from the drill string to the drill bit;

a steering collar having an axial bore therethrough through which said drive shaft extends, an annular space between said steering collar and said drive shaft defining an annulus for carrying pressurized drilling fluid, said steering collar further including:

at least two pistons responsive to the pressure of the drilling fluid coupled through the annulus between said steering collar and said drive shaft, said at least two pistons for moving axially outwardly from said steering collar to push said steering collar laterally in the borehole, said two pistons located less than 180 degrees apart around a circumference of said steering collar;

a respective pad moved by each said two pistons for engaging respective portions of a sidewall of the borehole;

a peg movable by a piston in response to a pressure of the drilling fluid, said peg for locking said steering collar to said drive shaft so that movement of the drill string is effective to rotate said steering collar to a desired angular orientation within said borehole; and whereby when the pistons of the steering collar are deployed, the steering collar is displaced laterally in the borehole to thereby deviate the path of the borehole, and for so long as said pistons are deployed the steering collar does not rotate but slides within the borehole during drilling to continue deviating the path of the borehole.

18. The rotary drilling system of claim 17, wherein said peg is moved into a locking position in response to a pressure of the drilling fluid of a first pressure, and said two pistons are moved outwardly by a drilling fluid pressure of a greater pressure.

19. The rotary drilling system of claim 17, further including a third piston movable outwardly from said steering collar to engage the sidewall of the borehole via a pad, said third piston being pressure relieved so as to exhibit a force less than a force presented by said two pistons, whereby said steering collar moves to the sidewall of the borehole adjacent the pressure relieved piston.

20. A method of controlling a direction of drilling of a borehole, comprising:

pumping a drilling fluid downhole through a drill string at a first pressure to activate a locking mechanism to lock a steering collar to the drill string and prevent relative rotary movement between the steering collar and the drill string, said steering collar surrounding a portion of said drill string located upstream from a drill bit, and said steering collar including at least one engaging member extendable therefrom;

rotating the drill string to thereby rotate the steering collar locked thereto and place said at least one extendable engaging member in a desired angular position within the borehole;

while at said desired angular position, pumping the drilling fluid downhole through the drill string at a second pressure different from said first pressure to force said at least one extendable engaging member radially outwardly from the steering collar, so that said at least one extendable engaging member pushes against a sidewall of the borehole;

moving one or more pistons with said second drilling fluid pressure to thereby force said at least one extendable engaging member into engagement with the sidewall of the borehole and push the steering collar away from the sidewall engaged to thereby cause a path of the borehole to be deviated in a desired direction; and disengaging the locking mechanism by removing said first drilling fluid pressure so that the drill string can rotate the drill bit and drill the borehole in the deviated path, while preventing the steering collar from rotating for so long as it is desired to deviate the path of the borehole.

* * * * *